United States Patent [19]

Manzelli

[11] 4,454,698

[45] Jun. 19, 1984

[54] MODULAR MEMBER FOR FORMING COMPOSITE FALSE-CEILINGS

[76] Inventor: Giorgio Manzelli, Via Sandro Gallo, 18, Lido di Venezia, Venezia, Italy

[21] Appl. No.: 378,553

[22] Filed: May 17, 1982

Related U.S. Application Data

[62] Division of Ser. No. 192,569, Sep. 30, 1980, abandoned.

[30] Foreign Application Priority Data

Sep. 28, 1979 [IT] Italy ..... 30785/79[U]
Dec. 7, 1979 [IT] Italy ..... 30826/79[U]

[51] Int. Cl.[3] ..... E04C 2/42

[52] U.S. Cl. ..... 52/581; 52/507; 52/663

[58] Field of Search ..... 52/663, 581, 484, 507; 46/25

[56] References Cited

U.S. PATENT DOCUMENTS

| | | | |
|---|---|---|---|
| 2,476,499 | 7/1949 | Lowell | 52/144 |
| 2,607,455 | 8/1952 | Yellinn | 52/663 |
| 2,680,698 | 6/1954 | Schnee | 404/41 |
| 2,693,102 | 11/1954 | Luster et al. | 52/392 |
| 3,086,629 | 4/1963 | Blitzer | 52/663 |
| 3,125,196 | 3/1964 | Fenner | 52/663 |
| 3,155,202 | 11/1964 | Millette | 52/663 |
| 3,740,914 | 6/1973 | Diez | 52/392 |

FOREIGN PATENT DOCUMENTS

| | | | |
|---|---|---|---|
| 293713 | 4/1967 | Australia | 52/144 |
| 1314591 | 12/1962 | France | 52/144 |
| 799175 | 8/1958 | United Kingdom | 52/660 |

*Primary Examiner*—James L. Ridgill, Jr.
*Attorney, Agent, or Firm*—Guido Modiano; Albert Josif

[57] ABSTRACT

A modular member for forming composite false-ceilings comprises two paired mating male and female cylindrical hollow lugs, each pair being provided with locking elements formed with holes for suspension elements, an annular ridge being furthermore provided as a rest for a cylindrical element included for aesthetic purposes or for a closing cap.

9 Claims, 10 Drawing Figures

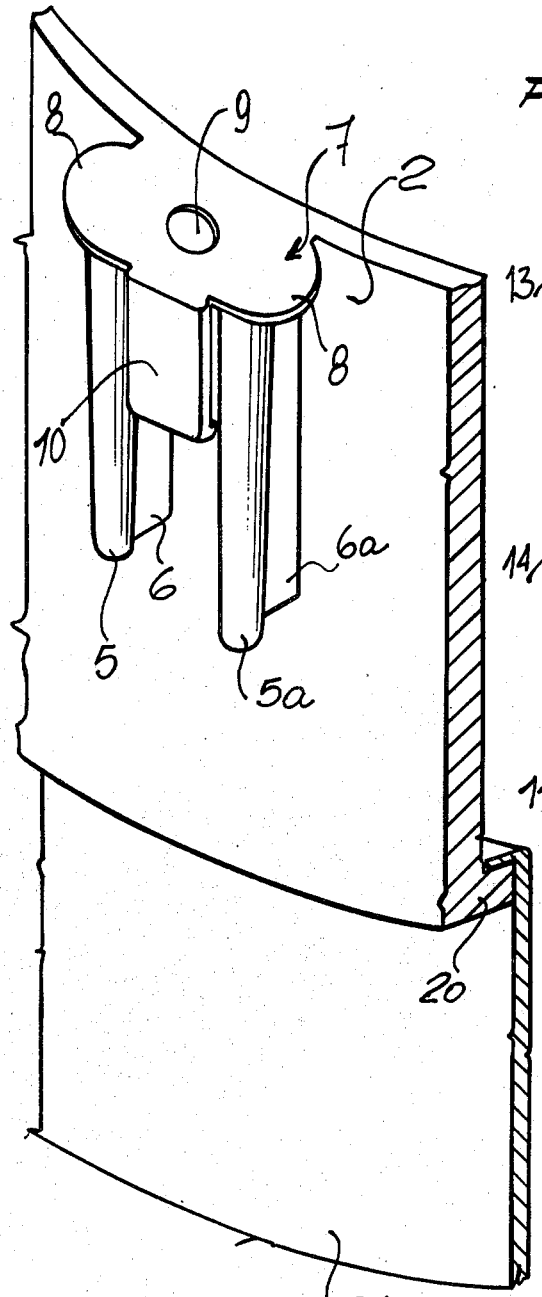
Fig. 3
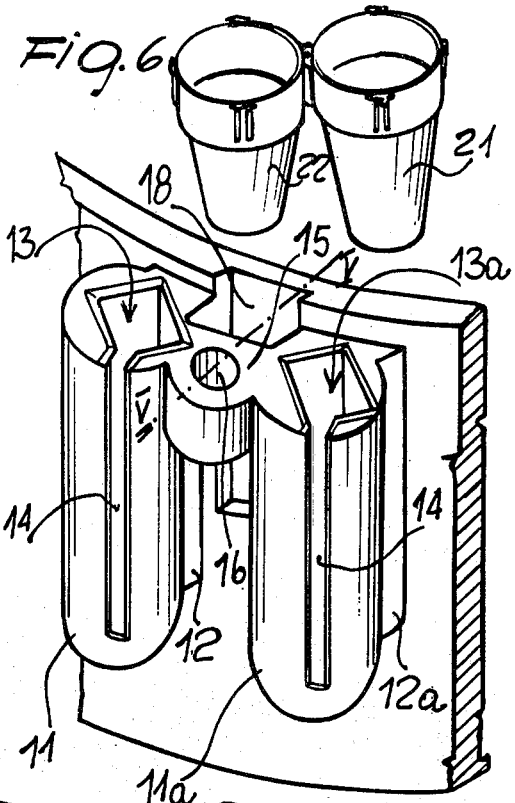
Fig. 6
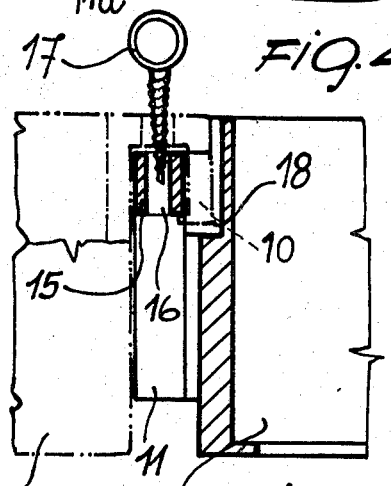
Fig. 4
Fig. 5

MODULAR MEMBER FOR FORMING COMPOSITE FALSE-CEILINGS

This is a division of application Ser. No. 192.569, filed Sept. 30, 1980, abandoned.

BACKGROUND OF THE INVENTION

This invention relates to a modular member or module for forming composite false-ceilings.

Various types of false-ceilings are currently available which comprise essentially modular pre-formed blocks which are then joined together by cementing in some cases and by clasps of various description in other cases.

Those methods have shown to be impractical both during the assembling steps and from the standpoint of their poor aesthetic appeal.

SUMMARY OF THE INVENTION

This invention sets out to provide a novel module for forming composite false-ceilings which can overcome the problems presented by conventional approaches, and features ease of assembling, versatility of application, and low manufacturing cost.

Within that general aim, it can be arranged that said modules are provided with multiple engagement means such as to enable modules of the same type to be assembled together in various fashion, while having different geometrical configurations, thereby variable pattern false-ceilings can be produced.

It is further possible to arrange that the module according to the invention has a simple construction, which can be readily manufactured as by molding from a plastics material, thus increasing the production output and reducing costs.

Furthermore, it is possible to arrange that this novel module is formed with internal projections serving as engagement means for additional accessory items intended for improving the color effects and appearance of the assembled false-ceiling.

According to one aspect of the present invention, there is provided a modular member or module for forming composite false-ceilings, characterized in that it comprises two paired engagement elements, respectively a male pair and female pair, including matching female socket lugs and male socket lugs, and means for locking said male and female engagement elements to mating female and male parts, each engagement pair being provided with locking elements of its own also formed with holes for suspension elements, an annular ridge being further provided as a resting means for a cylindrical element included for aesthetic purposes or to enhance the color effects, or for a closing cap.

BRIEF DESCRIPTION OF THE DRAWINGS

Further features and advantages of the invention will become more clearly apparent from the following detailed description of a preferred embodiment thereof, given herein by way of example only and illustrated in the accompanying drawings, where:

FIG. 3 is a fragmentary perspective view of the male pair of engagement elements;

FIG. 4 is a perspective view of the female pair of engagement elements;

FIG. 5 is a sectional view taken along the line V—V of FIG. 4;

FIG. 6 is a fragmentary perspective view of a false-ceiling incorporating cylindrical elements effective to enhance its appearance;

DESCRIPTION OF THE PREFERRED EMBODIMENTS

Figure 1:
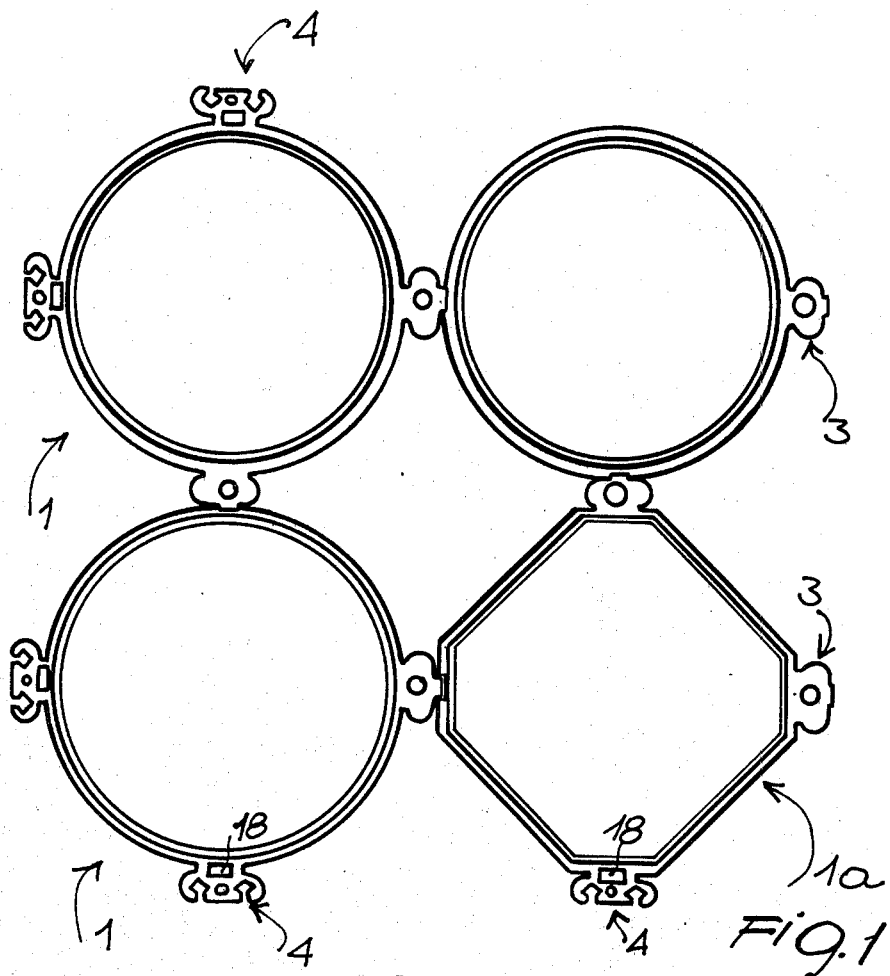
FIG. 1 is a plan view of several modular members or modules having different geometrical configurations.
Figure 2:
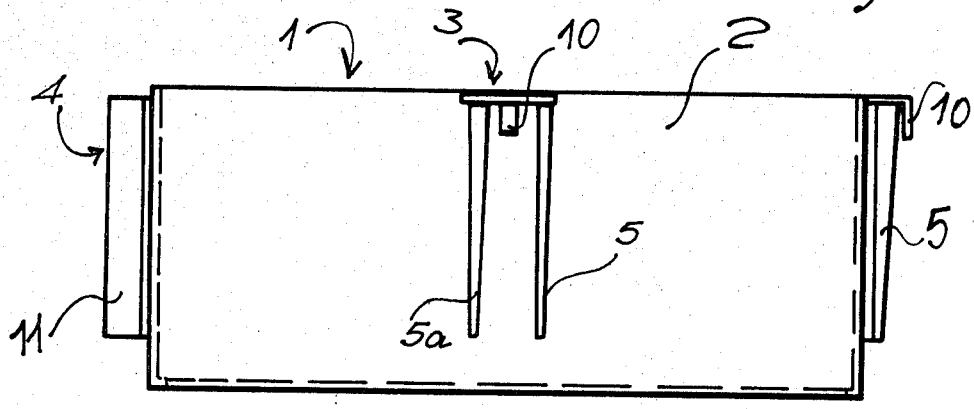
FIG. 2 is a side view of a module, showing the engagement elements (male pair and female pair)

With reference to the drawing figures, the modular member or module according to the invention is generally indicated at 1 and comprises a continuous surface 2 of either circular or quadrangular configuration and having at equal distances apart (substantially every 90°) two pairs of engagement elements, respectively a male pair 3 and female pair 4.

Said first male pair 3 includes two vertical pins or plugs 5 and 5*a* which taper substantially conically toward their lower ends and are associated with the wall 2 of the circular module 1 by means of a vertical rib 6 and 6*a*.

At the top said two pins are associated by and integral with a quasi-rectangular continuous surface 7 with a rounded off lower side 8 to form an integral part thereof.

At the middle region thereof, said continuous surface has a through hole 9 for the insertion of suspension elements from the coiling therein, as explained hereinafter.

On the front, that same surface carries an additional locking member 10 comprising a rigid lug, also quasi-rectangular in shape with bevels and rounded sides in order to facilitate the assembling of the individual modules together.

The female engagement pair 4 comprises instead two externally cylindrical elements 11 and 11*a* (having a slightly shorter length dimension with respect to the actual height dimension of the module 1), which are connected to said module by means of similar ribs 12 and 12*a* forming an integral part of the module itself.

Said two cylindrical elements are provided internally with two quadrangular seats or sockets 13 and 13*a*, wherein said two pins 5 and 5*a* of the male engagement pair are forcibly inserted for engagement therewith.

On the front, said cylindrical elements with quadrangular sockets 13 and 13*a* have two vertically extending slots 14 and 14*a* having the purpose of allowing for a limited elastic deformation during the operation of interconnecting two contiguous modules.

These two cylindrical elements are spaced apart from each other, while being interconnected to form a single piece by a frontally rounded sector 15 having at its middle portion a smaller diameter hole 16*a* whereinto a threaded element 17 is engaged which enables the individual assembled modules to be suspended from and secured to the ceiling.

Rearwardly from said sector 15, there is provided a vertically extending seat 18, into which said lug 10 engages to lock the individual modules together.

FIG. 5 shows a sectional view through the joint area between two modules 19 and 19*a*, illustrating the perfect match being obtained between the male and female joint pairs, which is further enhanced by the presence of the engaging lugs 10 to complete a stable and secure connection between said modules.

Obviously, in order to suspend from the ceiling the multiple modular structure obtained by assembling together either similar or different individual modules, provision is made for the insertion of the threaded suspension element.

In fact, the operator will thread it into the hole 16, provided for the female joint pair, thus achieving at the same time a definitive engagement of the male pair as well, owing to the provision of the through hole 9.

As shown in FIG. 3, each individual module is formed at the base thereof with an annular ridge 20 extending peripherally thereto and forming a means for securing a cylindrical element 21 to be inserted for aesthetic or coloring purposes.

Of course, the same can be replaced with a cap 22, also intended to accomplish a varying volume composition to produce peculiar visual effects.

It is noteworthy that the invention fully achieves its objects.

A novel module structure for false-ceilings has in fact been provided which is extremely simple, easily manufactured with conventional methods, and ensures low production costs.

It should be noted, in particular, that novel jointing means have been provided, which are also simplified, while quite effective in actual practice, said means being obviously strengthened in their action by the presence of additional engagement means, of the protruding lug type, such as to improve the overall reliability of the connection.

A further, and not negligible advantage of this invention is that it affords the possibility, without changing the configuration of the joint, of assembling different geometric configurations or patterns such as to produce varying false-ceilings of pleasing volumetric and aesthetic effects.

Finally, another advantage is that each module is provided with an internal protruding annular ridge, extending peripherally thereto, for engagement with other lugs of different shape and color, thereby improving the visual effect of the false-ceiling.

Figure 7:
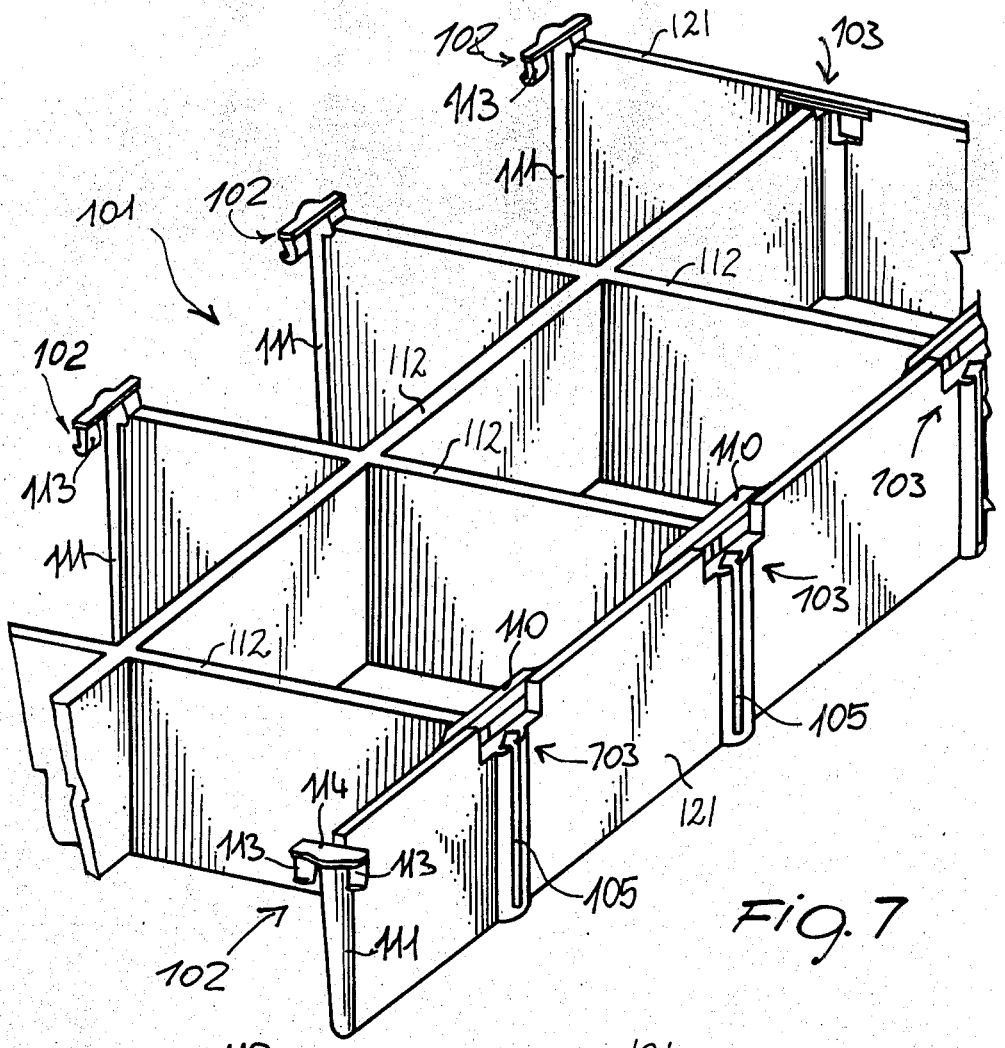
FIG. 7 is a fragmentary perspective view of a first embodiment of the module according to this invention.
Figure 10:
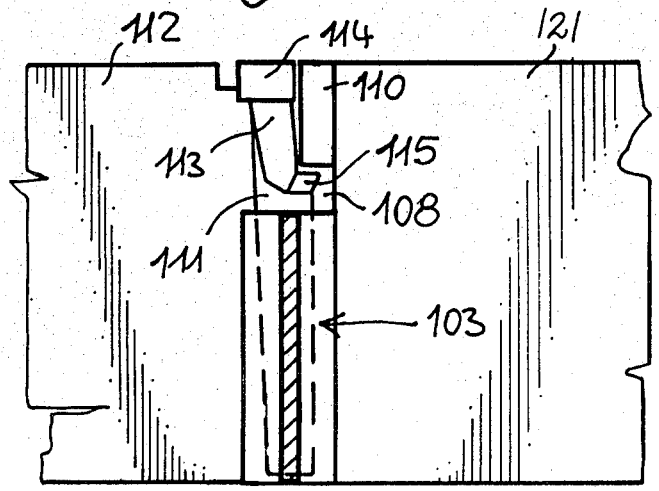
FIG. 10 is a sectional view of the interconnection area, taken along the line X—X of FIG. 8.

As a variation of the embodiment described hereinabove, the Applicant has deemed it suitable to modify somewhat the invention subject matter, while retaining the teachings thereof; in a particular way, this second solution finds it application ideally to those false-ceilings which result from the assembling of quadrangular modules, or modules provided with side pairs extending perpendicularly to each other and having a plurality of small cells forming a nest. In particular, as visible from Fig. 7, each module 101 is defined by a substantially rectangular grid formed by walls 112 extending perpendicularly to each other in a first and in a second direction. The end portions of said walls 112 define the outer sides of the grid, wherein in particular first two adjacent outer sides are delimited by side walls 121 having the same height as the walls 112 and defining the height of the module. As visible in the drawing, the side walls are connected with first end portions of said walls 112 which form said two adjacent outer sides, whereas second two outer sides, formed by the second end portions of the walls 112 are not delimited by side walls.

The clasp means which enable consecutive modules to be united together are shown in the already cited FIGS. 7 to 10, where the module, generally indicated at 101, is respectively provided, on the second two mutually perpendicular outer sides thereof, with male engagement elements 102, and female engagement elements 103 on the first two outer sides (also normal to each other). Male engagement elements 102 and female engagement elements 103 form matching engagement means extending outwardly to the grid 101.

Figure 9:
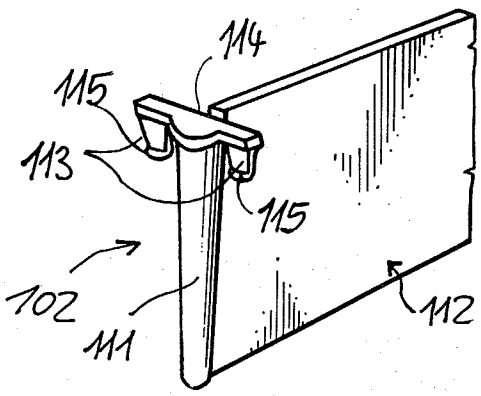
FIG. 9 is a fragmentary perspective view of the male socket or plug in said first embodiment.
Figure 8:
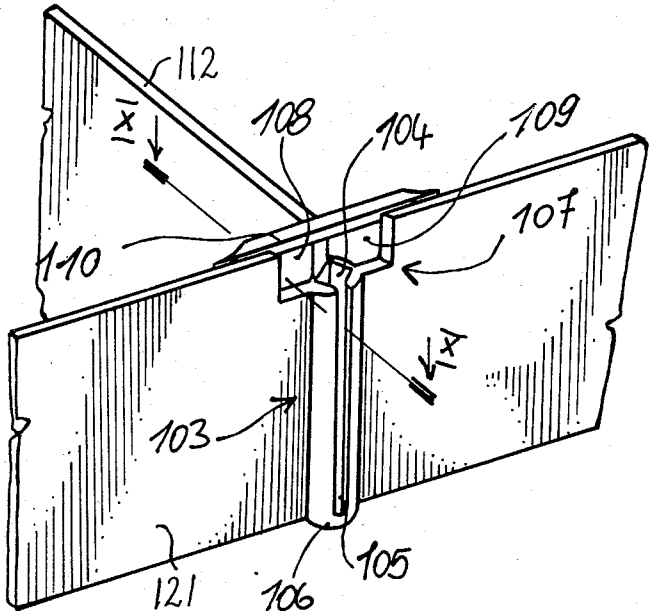
FIG. 8 is a fragmentary perspective view of the female socket in said first embodiment.

These engagement elements are substantially the subject matter of the variation, and for this reason have been shown detailedly in FIGS. 8 and 9.

The female engagement element 103, which as visible from the drawing, are arranged at the side walls 121 at the connection points thereof with the said portion of the walls 112 comprises a hollow vertical seat or cylindrical body 104 having a shorter length than the actual height of the module walls, the seat being rounded externally and having an inside hole, the cross-section thereof being quasi-quadrangular.

At the front thereof, the seat is interrupted by a vertical or longitudinal slot 105 which stops at the base 106 of said female engagement element 103 and defines a corner of the quadrangolar hole.

The top portion of that same engagement element opens to a housing or free portion 107 (for the subsequent male element), formed by a recess in the side wall 121 and provided respectively with two parts 108 and 109 devided by the respective end portion the wall 112 and an upper retaining cross-price 110.

The male elements, provided at the second end portion forming the second two adjacent outer sides and generally indicated at 102, comprises each a slightly conical pin 111 extending throughout the height of the wall 112 and having at the larger base thereof a pair of clasps or snap means 113 rigidly associated with a head 114. As visible in particular from FIG. 9, said head 114 extends substantially perpendicularly to the conical pin but parallel to the respective outer side of the grid, the head presenting a face looking towards the pin and supporting the snap means 113. The snap means 113, provided at the two sides of the pin 111, are formed by a lug departing from the head 114 in a direction substatially parallel to the pin.

Said pair of clasps 113 have, at the lower ends, an engagement tooth 115 which is bent at 90° such as to project outwardly from the grid and to engage in a stable manner into said ports 108 and 109 of the female engagement element.

During the assembling step, the vertical pin 111 is seated in said vertical groove 104, which is deformed elastically, while the wall 112 of the male element is inserted into the slot 105, thus aligning the entire connection. This same male element, when moved to the end of its travel, causes the pair of clasps 113 to insert their release-preventing teeth 115 into the ports 108 and 109, thus providing a stable and perfect connection of one module to the following one.

It will be apparent from the description of this first variation that the invention achieves its objects.

In fact, this solution also provides a module for composing false-ceilings, which is extremely simple, functional, and effective.

It should be noted in particular that this male/female connection is highly resistant to accidental shocks, owing to the presence of said projecting teeth, as well as resisting tensile efforts.

Another and not negligible advantage is that the connection is structurally simple, easily implemented from plastics material by injection molding, and variously adaptable to different shape modules, to result in aesthetically and visually pleasing false-ceilings.

Of course, in practicing the invention, some modifications may occur to the expert, and the materials, dimensions, and shapes may be any ones to suit individual requirements, without departing from the scope of the invention.

I claim:

1. A module for forming composite false-ceilings comprising a grid formed by walls extending transversely to each others in a first and in a second direction, said grid forming walls having end portions forming outer sides of said grid; at least, two side walls connected to end portion of said grid forming walls, said grid forming walls and side walls having an equal height defining a module height; matching engagement means provided at said outer sides of said grid and extending towards exterior of said grid, said matching engagement means consisting of male elements and female elements provided on different outer sides of said grid, each said male element comprising a substantially conical pin extending throughout said module height and having, at a larger base thereof, a head extending substantially perpendicularly to said conical pin, said head presenting a face looking towards said conical pin and supporting at said face at least one snap means, each female element comprising a substantially cylindrical body having smaller height than said module height thereby defining a free portion, said substantially cylindrical body presenting a hole therein and a longitudinal slot extending throughout said cylindrical body height, said free portion of said wall having at least one port cooperating with said at least one snap element of adjacent modules thereby causing a snap engagement of said snap element with said port and therefore a snap engagement of adjacent modules with each other.

2. A module according to claim 1, wherein said male elements are provided on and integral with said end portion of said grid forming walls and said female elements are provided on said side walls at connection points thereof with said grid forming walls.

3. A module according to claim 1, wherein at least one of said side walls extends parallel to said first direction.

4. A module according to claim 1, wherein one side wall extends parallel to said first direction and the other side walls extend parallel to said second direction and said grid has a substantially rectangular shape.

5. A module according to claim 1, wherein said first direction and second direction are perpendicular to each other.

6. A module according to claim 1, comprising a pair of snap means, arranged at two different sides of said pin, each snap means having a lug departing from said head in a direction substantially parallel to said pin and presenting, at an end opposite to said head, an outwardly projecting tooth for engaging in said at least one port.

7. A module according to claim 1, wherein said hole presents a quadrangular cross-section, a corner whereof being defined by said slot.

8. A module according to claim 1, wherein said at least one port is defined by a recess in said side wall at said free portion and by a cross-piece extending transversely in said recess.

9. A module for forming composite false-ceiling comprising a substantially rectangular grid formed by walls extending perpendicularly to each other in a first and in a second wall extending direction, the grid forming walls having end portions forming outer sides of said rectangular grid, at least two side walls defining two first adjacent outer sides of said grid and being connected with first end portions of said walls forming said first adjacent outer sides, said grid forming walls and side walls having a height defining a module height, matching engagement means consisting of male elements and female elements extending outwardly to said grid, said male elements being integral with second end portions of said grid forming walls defining two second adjacent outer sides of said grid each opposite to a respective of said two first adjacent outer sides, said male elements comprising a substantially conical pin extending throughout said module height and having, at a larger base thereof, a head member extending substantially perpendicularly to said conical pin but substantially parallel to a respective of the second two adjacent outer sides of the grid, said head having a face looking towards said conical pin and supporting at said face two snap means arranged at two opposite sides of said pin and having each a lug departing form said head in a direction substantially parallel to said pin, said lugs presenting each, at an end opposite to said head, a tooth outwardly projecting with respect to said grid for engaging with female elements of adjacent modules, said female elements being arranged on said side walls at connection points thereof with said first end portions, each female element comprising a substantially cylindrical body having a smaller height than said side wall height thereby defining a free portion of said side wall height, said side walls presenting a recess at said free portion defining, together with a cross-piece extending transversely to said recess, an engaging port for said teeth of said snap elements, each said port being divided in two parts by a respective first end portion of said grid forming walls, said substantially cylindrical body presenting a hole therein with quadrangular cross-section and a longitudinal slot extending throughout said cylindrical body height and defining a corner of said quadrangular hole thereby allowing the introduction of said pin in said hole and an elastic deformation of said cylindrical body as well as the snap engagement of said teeth in said ports and therefore of adjacent modules with each other.

* * * * *